US005238055A

United States Patent [19]

Kelley

[11] Patent Number: 5,238,055

[45] Date of Patent: Aug. 24, 1993

[54] FIELD ADJUSTABLE RAPPER TIE BAR

[75] Inventor: Brian C. Kelley, Columbus, Ohio

[73] Assignee: The Babcock & Wilcox Company, New Orleans, La.

[21] Appl. No.: 882,609

[22] Filed: May 13, 1992

[51] Int. Cl.[5] ..... F28G 7/00

[52] U.S. Cl. ..... 165/84; 165/95; 122/379

[58] Field of Search ..... 165/84, 95; 122/379

[56] References Cited

U.S. PATENT DOCUMENTS

| | | | |
|---|---|---|---|
| 3,835,817 | 9/1974 | Tuomaala | 122/379 |
| 3,997,000 | 12/1976 | Piela | 165/84 |
| 5,079,459 | 1/1992 | Huston et al. | 165/84 X |

FOREIGN PATENT DOCUMENTS

| | | | |
|---|---|---|---|
| 58-95199 | 6/1983 | Japan | 165/84 |
| 903690 | 2/1982 | U.S.S.R. | 165/84 |

*Primary Examiner*—Allen J. Flanigan
*Attorney, Agent, or Firm*—Harness, Dickey & Pierce

[57] ABSTRACT

An apparatus for cleaning deposits from heat exchange tubes in a boiler through the application of high frequency shock energy. The apparatus includes a tie bar which extends transverse of a row of heat exchange tubes in the boiler. A plurality of paired tube plates whose mounting positions are individually gaged from the tubes, are mounted to the tie bar and extend transversely from both the tie bar and the tubes. Plates are provided in pairs so as to have at least part of a row of the tubes firmly clamped therebetween. In this manner, the invention is readily mounted to existing banks of heat exchange tubes without requiring prior or precise knowledge as to the spacing between the tubes. Once properly positioned, the tube plates are fixedly secured to the tie bar.

16 Claims, 3 Drawing Sheets

FIELD ADJUSTABLE RAPPER TIE BAR

BACKGROUND AND SUMMARY OF THE INVENTION

The present invention generally relates to boiler cleaning and more particularly to cleaning the surfaces of heat exchange tubes in large scale industrial boilers by the application of high frequency shock energy.

It is well known that during operation of boilers, various combustion by-products become deposited on the boiler tubes and other heat transfer surfaces located within the boiler. These by-products accumulate as hardened encrustations of soot, slag, ash and scale. Unless frequently and thoroughly removed, the deposits cause significant heat loss and seriously impair the efficiency of the boiler. As modern boiler operating temperatures have increased and the use of lower quality fuels have become more commonplace, it has become increasingly difficult to remove the encrustations.

Various techniques have been utilized to remove the deposits from the surfaces of the boiler tubes. By way of illustration, these techniques include manual and automated sootblowers; manual scraping of the tube surfaces; and manual and automated use of air hammers to vibrate the tubes. Of these techniques, none have been found to be completely satisfactory and each has been found to have limitations and disadvantages.

One disadvantage of the vibrational type of cleaning systems, generally known as rappers, is that the systems require prior and relatively precise knowledge of the spacing between the individual tubes of the tube banks or bundles in the boiler. These known vibrational cleaning systems typically do not lend themselves to retrofitting applications and lack a large degree of field adjustability to accommodate for the existing variances in tube spacing.

With the above and other limitations in mind, it is an object of the present invention to provide an improved apparatus for cleaning surfaces of the heat exchange tubes in large scale industrial boilers. In achieving the above, the invention provides an apparatus which dislodges encrustations that have accumulated on the boiler tubes by the application of high frequency shock energy.

An additional object of this invention is to provide an apparatus which is readily retrofitted into existing boilers and which can accommodate a wide range of variations in boiler tube spacing. As such, the present invention is field adjustable.

These and other objects of the invention are obtained by providing an apparatus which generally comprises a vibrator for producing high frequency shock energy, a tie bar extending transversely of a row of heat exchange tubes, and a plurality of tube plates which extend generally transversely of both the tie bar and heat exchange tubes. During operation, high frequency shock energy is transmitted from the vibrator through both the tie bar and the tube plates to the heat exchange tubes causing the accumulated deposits to be dislodged.

According to one embodiment of the invention, the apparatus is adapted for cleaning generally horizontal heat exchange tubes which are mounted in parallel horizontal rows within the boiler. In this embodiment, the tie bar extends generally transversely of the length of the tubes and is positioned between vertically adjacent rows of the tubes. The tube plates are rigidly mounted to the tie bar adjacent to at least two tubes, one on each side of the tie bar and are also grouped in pairs so as to have the tubes positioned therebetween. At least one of the tube plates includes a tab or tube stop that extends between the vertically adjacent tubes along side of the tie bar. The tube stop prevents rotation of the entire assembly about the longitudinal axis of the tie bar. The vibrator is mounted externally of the boiler and is positioned to axially coincide with the tie bar. As an end of the tie bar is struck by a portion of the vibrator, high frequency shock energy is transmitted to the tubes causing dislodgement of the deposits.

In a second embodiment of the invention, the heat exchange tubes are vertically mounted. As in the prior embodiment, the tie bar extends generally transverse to the longitudinal (vertical) axis of the tubes and is positioned adjacent to at least one row of the tubes. The tube plates are again provided in pairs with each pair being arranged on opposing sides of a row of heat exchange tubes. The tube plates are mounted transverse to both the heat exchange tubes and the tie bar. Each pair of tube plates is rigidly attached to a row of the heat exchange tubes and welded to the tie bar so that high frequency shock energy is transmitted from the vibrator, through the tie bar and the tube plates, to the rows of the heat exchange tubes.

In each of the embodiments, the tie bar is mounted transversely to the longitudinal axis of the tubes and the tube plates are mounted transversely to the longitudinal axis of both the tie bar and the tubes. Because a multiple number of pairs are used and each pair of tube plates extends along an individual row of tubes, a multiple number of rows of the heat exchange tubes are cleaned by the transmission of the high frequency shock energy from a single vibrator.

The embodiments also enjoy increased flexibility since the tube plates are individually fitted onto the tie bar to compensate for individual tube spacing variations. Additionally, neither embodiment requires welding of the apparatus directly to the surfaces of the heat exchange tube. Because of the above advantages, the present invention can be used on existing tube banks, which may have uneven tube spacing, without requiring prior or precise knowledge of the actual tube spacing.

Additional benefits and advantages of the present invention will become apparent to those skilled in the art to which this invention relates from the subsequent description of the preferred embodiments and the appended claims taken in conjunction with the accompanying drawing.

DETAILED DESCRIPTION OF THE PREFERRED EMBODIMENTS

Figure 1:
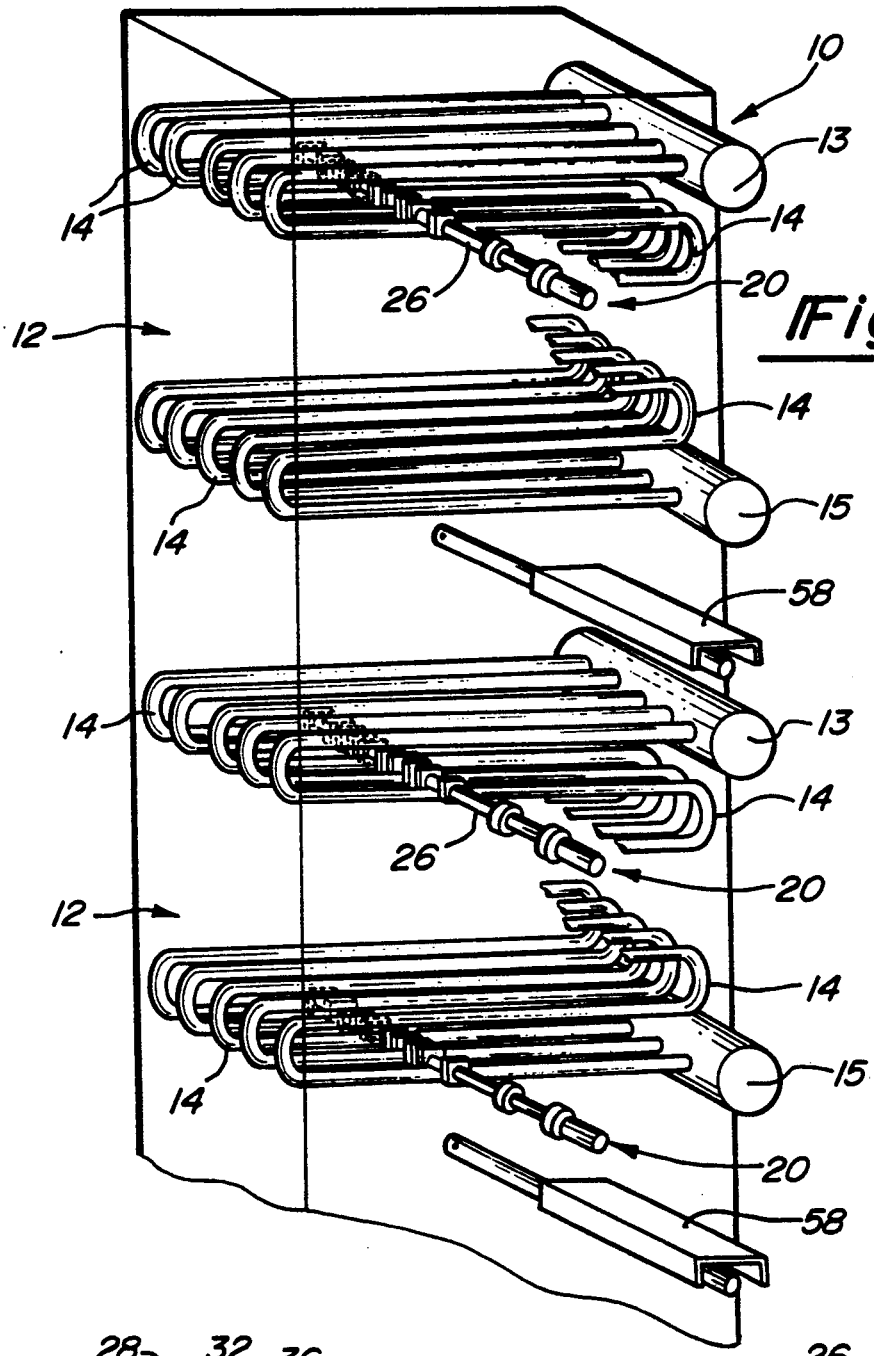
FIG. 1 is a diagrammatic perspective view of a boiler having horizontally oriented heat exchange tubes and utilizing one embodiment of the present invention for cleaning the tubes by the application of high frequency shock energy.

Referring now to the drawings, a large scale industrial boiler, as might be utilized by a utility company in a waste-to-energy or other power generating facility, is illustrated in FIG. 1 and generally designated at 10. Located within the boiler 10, in the flow of the hot combustion gases, are two super heater banks 12. Each super heater bank 12 is made up of a number of generally horizontally oriented heat exchange tubes 14 which extend between headers 13 and 15. For the sake of clarity, only a representative number of the tubes 14 are shown and designated. The tubes 14 are further arranged into a parallel series of horizontal rows and vertical columns. The tubes 14 are supported within the boiler 10 in a well known fashion which is not illustrated in the drawings since it does not form a part of the present invention.

As the boiler 10 is operated, combustion by-products of soot, slag, scale and ash become deposited as encrustations on the tubes 14. As these encrustations accumulate, the efficiency of the boiler 10 decreases. In order to clean the encrustations from the surfaces of the tubes 14, rapper assemblies 20 are mounted in the super heater banks 12 at locations predetermined to promote effective cleaning of the heat exchange tubes 14 through the application of high frequency shock energy. In the boiler 10 of FIG. 1, three rapper assemblies 20 are shown. As will be understood by one skilled in the art, a greater or lesser number of rapper assemblies 20, at varying locations, could alternatively be employed.

Each rapper assembly 20 generally includes a vibrator or rapper 22, an impact plate 24, a tie bar 26, and a number of tube plates 28, which are provided in pairs. As seen in the embodiment of FIG. 1, the rapper assemblies 20 are horizontally mounted so as to extend generally transversely to the longitudinal axes of the tubes 14.

Figure 2:
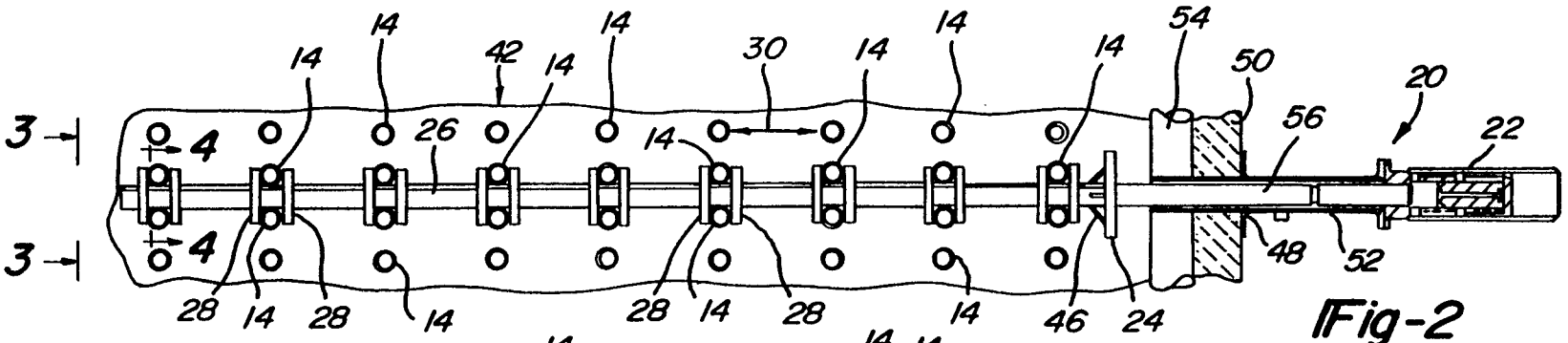
FIG. 2 is a vertical sectional view through four horizontal rows of boiler tubes showing the pairs of tube plates mounted to the tie bar and on opposing sides of the tubes.
Figure 6:
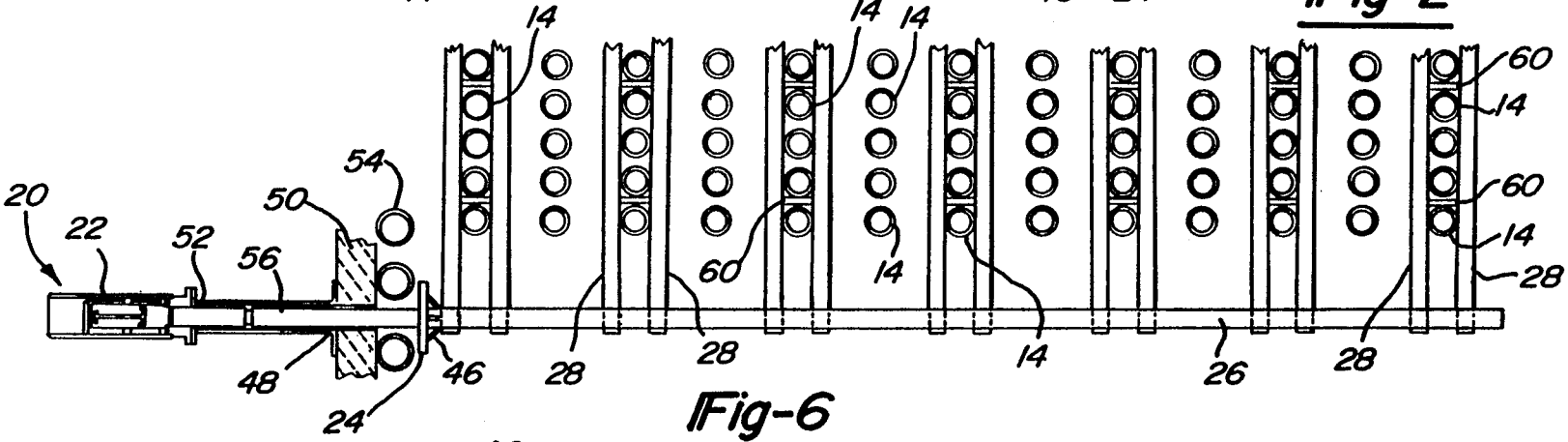
FIG. 6 is a horizontal sectional view taken substantially along line 6—6 in FIG. 5 showing pairs of tube plates mounted along opposing sides of the rows of tubes.
Figure 7:
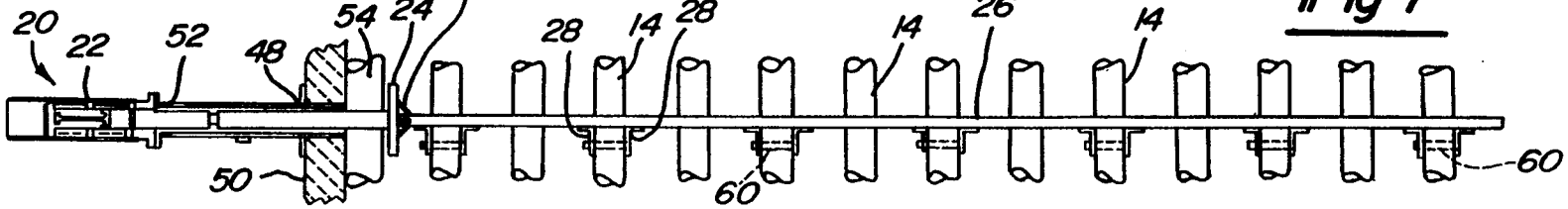
FIG. 7 is a side elevational view taken substantially along line 7—7 in FIG. 5 showing the mounting of the tie bar to the tube plates and the mounting of the tube plates to the heat exchange tube.

Referring now to FIG. 2, in the first embodiment of the present invention, the tie bar 26 is completely positioned within the boiler between two vertically adjacent horizontal rows 30 of the heat exchange tubes 14. The tie bar 26 itself is a long rod-like structure which extends across a substantial width of the super heater banks 12. In vertical section, the tie bar 26 preferably has a modified rectangular shape. The modified rectangular shape is best seen in FIG. 4.

Figure 4:
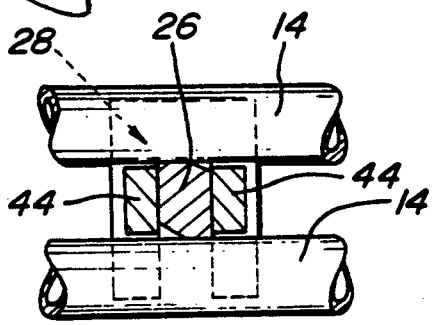
FIG. 4 is a sectional view taken substantially along line 4—4 in FIG. 2 illustrating the tube stops which prevent rotation of the assembly about the longitudinal axis of the tie bar.

As further seen in FIG. 4, the tie bar 26 exhibits a height which approximates the vertical spacing between adjacent horizontal rows 30 of the heat exchange tubes 14. Additionally, the tie bar 26 is provided with flat upper and lower surfaces 32, 33 and with flat side surfaces 34. To provide the tie bar 26 with a small amount of clearance that will readily enable the tie bar 26 to pass on its side between the horizontal rows 30 of the heat exchange tubes 14 during initial mounting of the rapper assembly 20, the upper and lower surfaces 32, 33 are interrupted by beveled surfaces 36. Once positioned between the horizontal rows 30 of tubes 14, the tie bar 26 can be rotated, because of the beveled surfaces 36, so that the flat side surfaces 34 are oriented generally vertically. The unique vertical sectional shape of the tie bar 26 thus prevents the tie bar 26 from being completely rotated about its longitudinal axis because the flat surfaces 32 and 33 come into contact with the tubes 14

Figure 3:
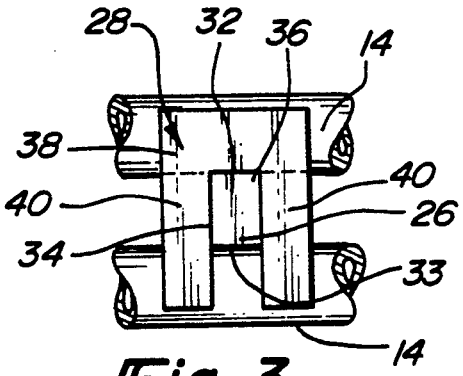
FIG. 3 is an end elevational view taken substantially along line 3—3 in FIG. 2 illustrating a tube plate mounted to the tie bar and its relational position to the heat exchange tubes.

The tube plates 28 are provided in pairs and are welded in position on the tie bar 26 so as to have a portion of the vertical columns 42 of the heat exchange tubes 14 entrapped therebetween. While the tube plates 28 are shown in FIGS. 2–4 as only having two heat exchange tubes 14 clamped therebetween, it is within the purview of this invention that a greater or lesser number of the heat exchange tubes 14 could also be so retained.

The tube plates 28 exhibit a shape which allows them to be individually positioned over the tie bar 26 after the tie bar 26 has been inserted between the horizontal rows 30 of the heat exchange tubes 14. The tube plates 28 are generally an inverted U-shape having a base 38 from which depend downwardly extending legs 40. The distance (width) between the legs 40 corresponds with the distance between the flat side surfaces 34 of the tie bar 26 and allows the tube plates 28 to fit down onto the tie bar 26.

At least one of the tube plates 28 is provided with tube stops or extensions 44 that project transversely from each of its legs 40 and, generally parallel to the longitudinal axis of the tie bar 26, between the horizontal rows 30 of tubes 14. In combination with the sectional shape of the tie bar 26, the extensions 44 prevent twisting or rotating of the assembly about the longitudinal axis of the tie bar 26. While it believed that only one tube plate 28 needs to be equipped with the extensions 44, it is preferred that two such tube plates 28, located at opposite ends of the tie bar 26, are employed. When provided in this manner, the extensions 44 prevent torsional forces from developing over the length of the tie bar 26.

A impact plate 24 is mounted to one end of the tie bar 26. If utilized, the impact plate 24 is positioned adjacent to a port 48 formed in the boiler wall 50 and through which an impact transfer pin 56 of the vibrator 22 extends. To provide for increased structural integrity in mounting the impact plate 24 to the tie bar 26, reinforcement ribs 46 are used.

The vibrator 22 may be a pneumatic or electromechanical hammer of a variety well known in the industry. One such electromechanical hammer is disclosed in U.S. Pat. No. 5,079,459, which is commonly assigned to the assignee of the present application and which is hereby incorporated by reference. The vibrator 22 is mounted to one end of a sleeve 52 that extends through the port 48 in the boiler wall 50. The sleeve 52 also may extend through a bank of wall tubes 54 mounted along the boiler wall 50. The impact transfer pin 56 extends from the driving end of the vibrator 22 through the sleeve 52 and is biased by a spring (not shown) in contact with the impact plate 24.

During operation of the rapper assembly 20, the vibrator 22 is actuated to cause an internal hammer 55 to strike the impact transfer pin 56 transmitting the shock energy at a high frequency through the impact plate 24 to the tie bar 26. Being axially aligned with the tie bar 26, the transfer of high frequency shock energy is accomplished efficiently. This energy is then transferred through the tube plates 28 to the heat exchange tubes 14, clamped therebetween, dislodging the encrustations and cleaning the exterior surfaces of the tubes 14. As seen in FIG. 1, to further ensure a high degree of cleaning, the rapper assembly may be used in conjunction with one or more sootblowers 58.

Figure 5:
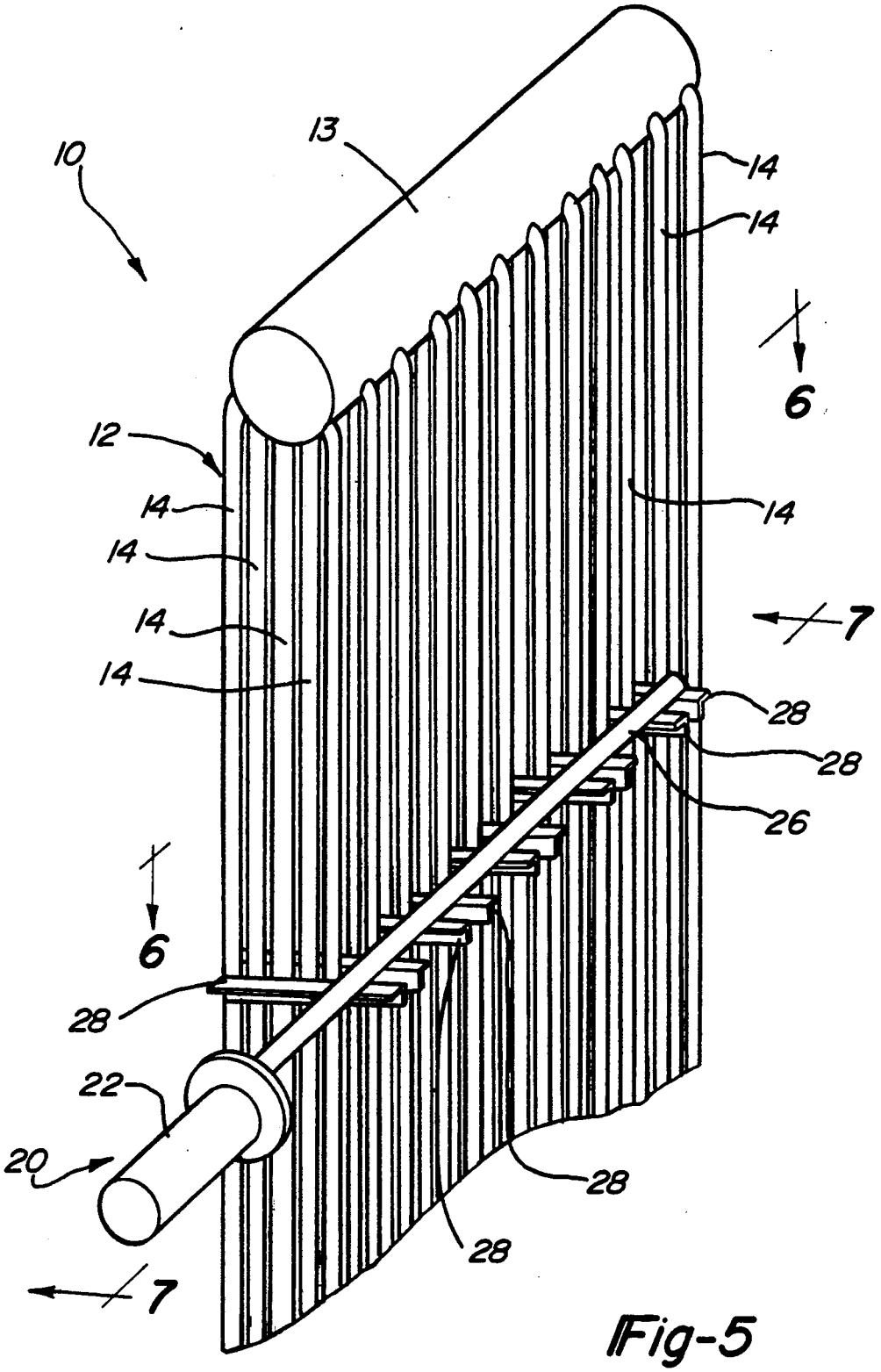
FIG. 5 is a diagrammatic perspective view of a boiler having vertically oriented heat exchange tubes and utilizing another embodiment of the present invention for cleaning the tubes through the application of high frequency shock energy.

Referring now to FIG. 5, a large scale industrial boiler 10 is illustrated having two super heater banks 12, with each super heater bank 12 being made up of a number of generally vertically oriented heat exchange tubes 14 which are also arranged in a parallel series of rows and columns extending from a header 13.

A second embodiment of the rapper assembly 20 is utilized with the vertically extending heat exchange tubes 14. A tie bar 26 is positioned adjacent to one row 30 of the heat exchange tubes so as to extend generally transversely to the longitudinal axis of the tubes 14. Unlike the prior embodiment, the cross sectional shape of the tie bar 26 in the second embodiment is not utilized to prevent rotation of the rapper assembly 20. In the second embodiment, the tie bar 26 is positioned along the side of the super heater bank 12 thus illustrating the preferred method of mounting the rapper assembly 20 when the spacing between the individual tubes 14 will not permit insertion of the tie bar 26 therebetween.

The tube plates 28 extend transversely from the tie bar 26 and are provided in pairs on opposing sides of the columns of tubes 14. Each pair of tube plates 28 is rigidly secured to the columns of the tubes 14 by threaded fasteners 60 causing the tubes to be clamped between the tube plates 28 and any rotation prohibited. With the tube plates rigidly secured to the columns of heat exchange tubes 14, the tie bar 26 can be supported by the tube plates 28. Preferably, the tie bar 26 is welded to the tube plates 28. To further promote the support of the tie bar 26, the tube plates 28 may be formed of angle iron thereby providing a generally horizontal mounting surface for the tie bar 26.

In mounting the second embodiment of the rapper assembly 20 to an existing super heater bank 12, the tube plates 28 are first secured to the tubes 14 by the threaded fasteners 60 so as to extend along opposing sides of a column of the tubes 14. Once the tube plates 28 have been secured in position, the tie bar is placed upon the tube plates 28 and welded thereto.

An impact plate 24 is mounted to one end of the tie bar 26. As in the prior embodiment, the impact plate is positioned adjacent a port 48 formed in the boiler wall 50 to which the impact pin 56 of the vibrator 22 will extend.

A vibrator 22, of the variety discussed above, is axially mounted to induce vibration in the tie bar 26. The efficient transfer of the high frequency shock energy to the tie bar 26 is in turn transferred through the tube plates 28, because of their transverse mounting, to the tubes 14 dislodging the encrustations. In this manner, the tubes 14 are effectively and efficiently cleaned.

While the above description constitutes the preferred embodiments of the present invention, it will be appreciated that the invention is susceptible to modification, variation and change without departing from the proper scope and fair meaning of the accompanying claims.

What is claimed is:

1. An apparatus for cleaning deposits from a row of spaced apart heat exchange tubes in a boiler by transferring high frequency shock energy to the heat exchange tubes from a source of vibration having means for transmitting the high frequency shock energy into the boiler, a length of each of the heat exchange tubes defines an axis, said apparatus comprising:

a tie bar adapted for complete positioning within the boiler, said tie bar exhibiting a length and having first and second ends, said tie bar being positionable such that said length extends generally transverse of and adjacent to the axes of the heat exchange tubes, said tie bar further being positionable such that said first end is capable of receiving high frequency shock energy produced by the source of vibration and transmitted into the boiler; and a plurality of tube plates being individually positionable in transverse fashion with respect to the heat exchange tubes and being spaced apart and fixedly mounted to said tie bar so as to extend generally transversely of the length of said tie bar, said tube plates being spaced apart on said tie bar so as to enable positioning with the heat exchange tubes adjacent thereto and enabling the transmission of high frequency shock energy through said tie bar and said tube plates to the heat exchange tubes causing the deposits to be dislodged therefrom.

2. An apparatus as set forth in claim 1 wherein said tube plates are provided in pairs.

3. An apparatus as set forth in claim 2 wherein said tube plates are provided in pairs being individually positionable on opposing sides of one of the heat exchange tubes.

4. An apparatus for cleaning deposits from a row of heat exchange tubes oriented in a boiler generally along horizontal axes defined with respect to their lengths and exhibiting varying tube spacing therebetween, said cleaning being performed through the transmission of high frequency shock energy to said heat exchange tubes, said apparatus comprising:

vibrator means for producing high frequency shock energy;

a tie bar being completely positionable within the boiler, said tie bar having a length extending between first and second ends, said tie bar adapted to extend generally transverse of the axes and adjacent to the heat exchange tubes, said first end being positionable to receive high frequency shock energy produced by said vibrator means; and a plurality of paired plates, each pair of said paired plates being individually positionable with respect to the heat exchange tubes so as to have one of the heat exchange tubes therebetween and so as to extend transversely relative thereto, said paired plates being fixedly secured to said tie bar and extending generally transversely therefrom, said apparatus thereby enabling the transmission of high frequency shock energy to the heat exchange tubes for causing dislodgement of the deposits therefrom.

5. An apparatus as set forth in claim 4 wherein the tie bar is adapted to be supported by the heat exchange tubes.

6. An apparatus as set forth in claim 4 wherein said means includes a member adapted to extend generally parallel to said longitudinal axis of said tie bar between two adjacent heat exchange tubes.

7. An apparatus as set forth in claim 4 wherein said paired plates are welded to said tie bar.

8. An apparatus as set forth in claim 4 wherein said vibration means is actuated axially with respect to said tie bar.

9. An apparatus as set forth in claim 4 wherein said tie bar is adapted for positioning between adjacent rows of the heat exchange tubes.

10. An apparatus for cleaning deposits from a row of heat exchange tubes defining substantially vertical axes with respect to their length and positioned with a boiler, the heat exchange tubes exhibiting varied tube spacing therebetween and said cleaning being performed by the transmission of high frequency shock energy to the heat exchange tubes, said apparatus comprising:

vibrator means for producing high frequency shock energy;

a tie bar being completely positionable within the boiler, said tie bar having first and second ends and a length extending therebetween, said tie bar adapted to extend generally transversely of and adjacent to the row of said heat exchange tubes, said first end being located to receive high frequency shock energy originating from said vibrator means; and a plurality of tube plates arranged in pairs, each pair of said tube plates being individually mountable and rigidly securable to one of the heat exchange tubes generally transverse to the axes thereof with the heat exchange tube therebetween, said tie bar being rigidly mounted to and supported by said tube plates with said tube plates positioned substantially transverse to the length of said tie bar thereby enabling efficient transmission of high frequency shock energy to the heat exchange tubes for causing the deposits to be dislodged therefrom.

11. An apparatus as set forth in claim 10 wherein said tie bar is positioned so as to axially receive the high frequency shock energy.

12. An apparatus for cleaning deposits from a row of spaced apart heat exchange tubes in a boiler by transferring high frequency shock energy from a source of vibration, an axis is defined by a length of each of the heat exchange tubes, said apparatus comprising:

a tie bar exhibiting a length and having first and second ends, said tie bar being positionable such that said length extends generally transverse of the axes of the heat exchange tubes, and such that said first end is capable of receiving high frequency shock energy originating from the source of vibration; and a plurality of heat plates being rigidly mounted to said tie bar at spaced intervals along its length, said tube plates being individually positionable on said tie bar so as to extend transversely with respect to the axes of the heat exchange tubes and said tie bar, said tube plates being spaced apart enabling the heat exchange tubes to be positioned adjacently therebetween, said tube plates also adapted for rigid mounting to the heat exchange tubes thereby enabling the transmission of high frequency shock energy to the heat exchange tubes for causing the deposits to be dislodged therefrom.

13. An apparatus for cleaning deposits from a row of heat exchange tubes oriented in a boiler generally along horizontal axes defined with respect to their lengths and exhibiting varying tube spacing therebetween, said cleaning being performed through the transmission of high frequency shock energy to said heat exchange tubes, said apparatus comprising:

vibrator means for producing high frequency shock energy;

a tie bar having a length extending between first and second ends, said tie bar being positionable to extend generally transverse of the axes and adjacent to the row of heat exchange tubes, said first end adapted to receive high frequency shock energy produced by said vibrator means; and a plurality of paired plates, said paired plates being generally U-shaped having a pair of dependent legs and a central recess therebetween, said paired plates being rigidly mounted to said tie bar with said tie bar being positioned within said central recess and between said pair of dependant legs, said paired plates being individually positioned and fixedly secured to said tie bar so as to extend generally transversely from said length of said tie bar and from the axes of the heat exchange tubes thereby enabling the transmission of high frequency shock energy to the heat exchange tubes causing dislodgement of the deposits therefrom.

14. An apparatus for cleaning deposits from a row of heat exchange tubes oriented in a boiler generally along horizontal axes defined with respect to their lengths and exhibiting varying tube spacing therebetween, said cleaning being performed through the transmission of high frequency shock energy to said heat exchange tubes, said apparatus comprising:

vibrator means for producing high frequency shock energy;

a tie bar having a length extending between first and second ends, said tie bar being positionable to extend generally transverse of the axes and adjacent to the row of heat exchange tubes, said first end being positionable to receive high frequency shock energy produced by said vibrator means; and a plurality of paired plates being individually positioned and fixedly secured to said tie bar at spaced apart intervals along said length so as to extend generally transversely from said length thereof, said paired plates adapted to receive a heat exchange tube therebetween and to extend generally transversely from the axes of the heat exchange tube enabling the transfer of high frequency shock energy to the heat exchange tubes causing dislodgement of the deposits therefrom, at least one of said paired plates including means for preventing rotation of said tie bar about a longitudinal axis of said tie bar.

15. An apparatus for cleaning deposits from a row of heat exchange tubes oriented in a boiler generally along horizontal axes defined with respect to their lengths and exhibiting varying tube spacing therebetween, said cleaning being performed through the transmission of high frequency shock energy to said heat exchange tubes, said apparatus comprising:

vibrator means for producing high frequency shock energy;

a tie bar having a length extending between first and second ends, said tie bar being eccentric in transverse section, said tie bar being positionable to extend generally transverse of said axes and adjacent to the row of heat exchange tubes, said first end adapted to receive produced by said vibrator means; and a plurality of paired plates, said paired plates being individually positioned and fixedly secured to said tie bar to extend generally transversely therefrom, said tie bar being positionable such that said tube plates extend transversely relative to the axes of the heat exchange tubes enabling the transmission of high frequency shock energy to the heat exchange tubes causing dislodgement of the deposits therefrom.

16. An apparatus for cleaning deposits from a row of heat exchange tubes defining substantially vertical axes with respect to their length and positioned within a boiler, the heat exchange tubes exhibiting varied tube spacing therebetween, said cleaning being performed by the transmission of high frequency shock energy to the heat exchange tubes, said apparatus comprising:

vibrator means for producing high frequency shock energy;

a tie bar having first and second ends and a length extending therebetween, said tie bar being positionable to extend generally transversely of and adjacent to the row of said heat exchange tubes, said first end being being positionable to receive high frequency shock energy produced by said vibrator means; and a plurality of tube plates arranged in pairs, each pair of said tube plates being adapted for individual mounting and rigid securement on opposing sides of one of the heat exchange tubes by fasteners so as to extend generally transverse to the axes thereof, said tie bar being rigidly mounted and supported by said tube plates with said length of said tie bar extending substantially transversely to said tube plates enabling efficient transmission of high frequency shock energy to the heat exchange tubes causing the deposits to be dislodged therefrom.

* * * * *

UNITED STATES PATENT AND TRADEMARK OFFICE

CERTIFICATE OF CORRECTION

PATENT NO. : 5,238,055

DATED : August 24, 1993

INVENTOR(S) : Brian C. Kelley

It is certified that error appears in the above-indentified patent and that said Letters Patent is hereby corrected as shown below:

Column 7, line 9, Claim 10, after "positioned" please delete "with" and insert —within—.

Column 10, line 3, Claim 16, after first "being" delete second "being".

Column 10, line 13, Claim 16, after "substantially" delete "transversely" and insert therefore —transverse—.

Signed and Sealed this

Twentieth Day of September, 1994

Bruce Lehman

*Attest:*

BRUCE LEHMAN

*Attesting Officer*

*Commissioner of Patents and Trademarks*